US007883298B2

(12) United States Patent
Brandl

(10) Patent No.: US 7,883,298 B2
(45) Date of Patent: Feb. 8, 2011

(54) SUPPORTING DEVICE FOR AN ADVANCE WORKING OR MINING MACHINE

(75) Inventor: Erich Brandl, Grosslobming (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 195 days.

(21) Appl. No.: 12/309,720

(22) PCT Filed: Jul. 20, 2007

(86) PCT No.: PCT/AT2007/000355

§ 371 (c)(1),
(2), (4) Date: Jan. 27, 2009

(87) PCT Pub. No.: WO2008/011647

PCT Pub. Date: Jan. 31, 2008

(65) Prior Publication Data

US 2009/0191011 A1 Jul. 30, 2009

(30) Foreign Application Priority Data

Jul. 28, 2006 (AT) ..... A 1285/2006

(51) Int. Cl.
*E21D 23/03* (2006.01)

(52) U.S. Cl. ..... 405/294; 405/293; 299/33

(58) Field of Classification Search ..... 405/141, 405/288, 290, 291, 293, 294, 295, 296, 297; 299/11, 12, 33
See application file for complete search history.

(56) References Cited

U.S. PATENT DOCUMENTS

| | | | | | |
|---|---|---|---|---|---|
| 3,333,426 | A | * | 8/1967 | Jackson | 405/297 |
| 3,375,668 | A | * | 4/1968 | Allen | 405/293 |
| 3,626,700 | A | * | 12/1971 | Groetschel | 405/299 |
| 3,646,769 | A | | 3/1972 | Pollard | |
| 3,812,681 | A | * | 5/1974 | Allen | 405/299 |
| 3,978,675 | A | | 9/1976 | Jenkins et al. | |
| 4,065,929 | A | * | 1/1978 | Simpson | 405/293 |
| 4,146,271 | A | * | 3/1979 | Ward et al. | 405/302 |
| 4,226,476 | A | | 10/1980 | Fairchild et al. | |
| 4,252,475 | A | | 2/1981 | Cobb et al. | |
| 4,740,037 | A | | 4/1988 | Eager et al. | |
| 4,865,390 | A | * | 9/1989 | Shrader et al. | 299/33 |
| 4,953,914 | A | * | 9/1990 | LeBegue | 299/33 |
| 5,582,467 | A | * | 12/1996 | Drolet et al. | 299/33 |
| 5,743,679 | A | * | 4/1998 | Gottschlich | 405/293 |
| 6,305,754 | B1 | * | 10/2001 | Uehara et al. | 405/138 |
| 6,942,301 | B2 | | 9/2005 | Brandl et al. | |

FOREIGN PATENT DOCUMENTS

| | | |
|---|---|---|
| DE | 1 947 378 | 4/1970 |
| DE | 39 23 376 C1 | 7/1990 |
| GB | 2 077 809 A | 12/1981 |
| WO | WO 02/20946 A1 | 3/2002 |

* cited by examiner

*Primary Examiner*—Frederick L Lagman
(74) *Attorney, Agent, or Firm*—Chapman and Cutler LLP

(57) ABSTRACT

In a supporting device (2) for an advance working or mining machine (1), including support props (3) and at least one roof bar (4), the roof bar(s) (4), on their sides facing away from the support props (3), include(s) a plurality of support cylinders (5) with support stops, which can be separately braced against the roof.

20 Claims, 4 Drawing Sheets

SUPPORTING DEVICE FOR AN ADVANCE WORKING OR MINING MACHINE

The invention relates to a supporting device for an advance working or mining machine, including support props and at least one roof bar.

In order to enable, with such an advance working or mining machine, the extraction of rock during the substantially simultaneous advance of the formation of the protection walling, parallel anchoring by boring and setting anchors simultaneously with the cutting operation is required to subsequently enable the fixation of roof sheathing and other support elements to the same.

From DE 3529644 A1, an advance working machine suitable for such parallel anchoring has become known, wherein the supporting structure reaches as far as to directly above the frame of the advance working machine. Anchor boring and setting devices are arranged in a manner displaceable relative to the frame and, during anchoring, have to be braced separately between the roof and the floor.

An articulated supporting device with an integrated anchor boring and setting device can be taken from AT 392116 B. In that construction, a supporting frame is connected with the frame of the advance working machine via connecting rods extending in the longitudinal direction of the machine.

A supporting frame articulately arranged relative to the advance working machine and having an integrated anchor boring and setting device, in which several props form a support unit between the roof and the floor, may, for instance, be taken from U.S. Pat. No. 4,865,390. The temporary support to be achieved using such rock props covers relatively small surface areas.

The invention aims to provide a supporting device for an advance working and mining machine, which is characterized by a particularly efficient temporary support of the roof without involving excessive restriction of the working area of anchor boring and setting devices. Simultaneously with such an enlarged temporary support, also the stability of the advance working machine is to be safeguarded even under high break-in forces and an enhanced protection for the respective operators is to be ensured.

To solve this object, the supporting device according to the invention substantially consists in that the roof bar(s), on their sides facing away from the support props, comprise a plurality of support cylinders with support stops, which can be separately braced against the roof. By the roof bars comprising, on their sides facing the roof and facing away from the support props, a plurality of support cylinders with support stops, which can be separately braced against the roof, the permanent contact of all contact elements of the supporting device with the roof will be ensured. In this manner, the safety regulations for underground working will be complied with while, at the same time, enabling the introduction of the respective support forces into the rock in an appropriately careful way via a plurality of contact points in a manner distributed over a major surface area. An excessive contact pressure in partial regions will thus be safely avoided.

In a particularly simple manner, the configuration is devised such that a roof bar cooperates with at least two eccentrically engaging support props transversely to the longitudinal direction of the advance working machine or mining machine, wherein, in a preferred manner, the roof bar is designed to be U-shaped in ground plan and support cylinders are each arranged in the region of the free ends of the U-branches and on the side of the roof bar located opposite the pivot axis of the roof bar, which axis is defined by the points of engagement of the support props on the roof bar, seen in top view. By the roof bar extending over the width of the mining machine and carried by eccentrically engaging support props, the pivotability of the roof bar about an axis corresponding to the connection line of the points of engagement of the two eccentrically engaging support props will be ensured on the points of engagement of the support props. Said pivot axis forms a two-armed lever, with higher support forces being introducible via the shorter lever arm than via the longer lever arm. The particularly advantageous configuration of the roof bar as a plate U-shaped in cross section with support props arranged in the region of the free ends of the U-branches allows for the introduction of appropriately reduced support forces into the roof via said support props arranged on the free ends of the U-branches, whereas the support props arranged on the other side of the previously defined pivot axis and located on the shorter lever arm are able to transmit substantially higher forces in the region of the machine itself. The U-shaped ground plan provides an appropriately large free space between the free branches, thus allowing anchor boring and setting devices to be inserted in the desired manner without hindrance. With such a configuration, a rock contact with the hanging wall will be ensured by deploying the respective support cylinder, with lower support forces being introduced in the forward region of the support plate near the cutter head as in correspondence with the lever ratio defined by the pivot axis. The risk of a breakout near the mine face, which is particularly jeopardized during cutting because of the vibrations caused thereby, will thus be substantially reduced. Herein the configuration is advantageously devised such that the distance of the support cylinders facing the forward end of the machine from the pivot axis defined by the support props is 2 to 7 times, preferably 3 to 5 times, the distance of the support cylinders on the other side of the pivot axis from the pivot axis.

In principle, the support cylinders merely serve to maintain constant contact with the roof. The configuration is, therefore, advantageously devised such that the maximum hydraulic pressure of the support cylinders is selected to be below 35%, preferably about 20%, of the hydraulic pressure of the support props. In this manner, it will be ensured that, in the event of a local breakout of the hanging wall under one of the four support cylinders, only the latter will be readjusted until contact with the rock is restored. The pressure that builds up within the tracking support cylinder can then be adjusted so as to avoid a change in the position of the support plate. The support force will thus be introduced into the rock in a manner distributed over the remaining, in the present case three, support cylinders.

In order to safely introduce thrust forces into the machine, the support plate in a manner known per se can be articulately connected with the rear frame of the advance working machine by push rod elements.

The controlling means required for readjusting the pressure may be devised such that the support cylinders are connected with a hydraulic controller maintaining a defined application pressure, wherein, however, after a local breakout under one of the support cylinders, the latter will not merely be hydraulically readjusted but rather run-up to a previously defined application pressure, as already pointed out above.

The supporting device according to the invention in a particularly simple manner will ensure the separate introduction of forces via the supporting device and via the anchor boring and setting devices, wherein the configuration is advantageously devised such that the support props are supported on the machine frame and that the anchor boring and setting devices are supported on a frame of the loading device. In any case, the geometric configuration of the roof bar is advantageously devised such that the anchor boring and setting devices are arranged within the surface area stretched by the support cylinders, seen in top view.

An enhanced protection of the operator will be achieved by laterally adjustable protective shields and/or roof elements laterally extractable from the roof bar, which are known per se.

In the following, the invention will be explained in more detail by way of an exemplary embodiment schematically illustrated in the drawing, of an advance working and mining machine according to the invention including the supporting device according to the invention. Therein, FIG. 1 is a perspective view of an advance working machine laterally from front;

Figure 1:
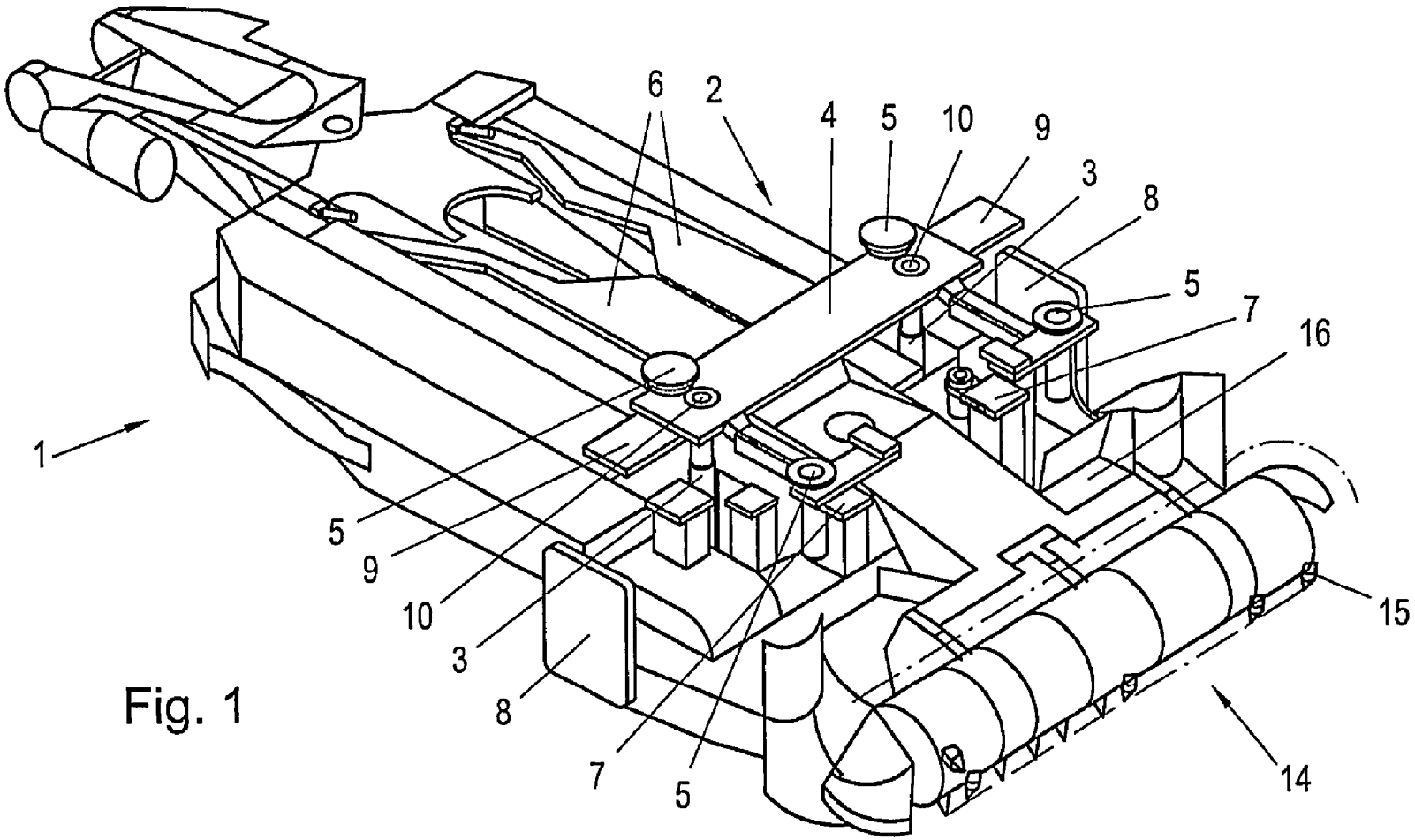

FIG. 1 illustrates an advance working and mining machine 1, which is equipped with the supporting device 2 according to the invention, comprising a U-shaped roof bar 4 pivotally mounted on support props 3 in supporting points 10 and equipped with hydraulic support cylinders 5. The roof bar 4 is articulately connected with the rear frame of the advance working machine 1 via push rods 6. An anchor boring and setting device is indicated at 7. In addition to the protection provided by the roof bar 4 and the supporting device 2, respectively, laterally adjustable protective shields 8 and roof elements 9 extractable from the roof bar, which are known per se, are provided. The cutter drum 14 with the cutter heads 15 attached thereto as well as the haulage means 16 are also shown.

Figure 2:
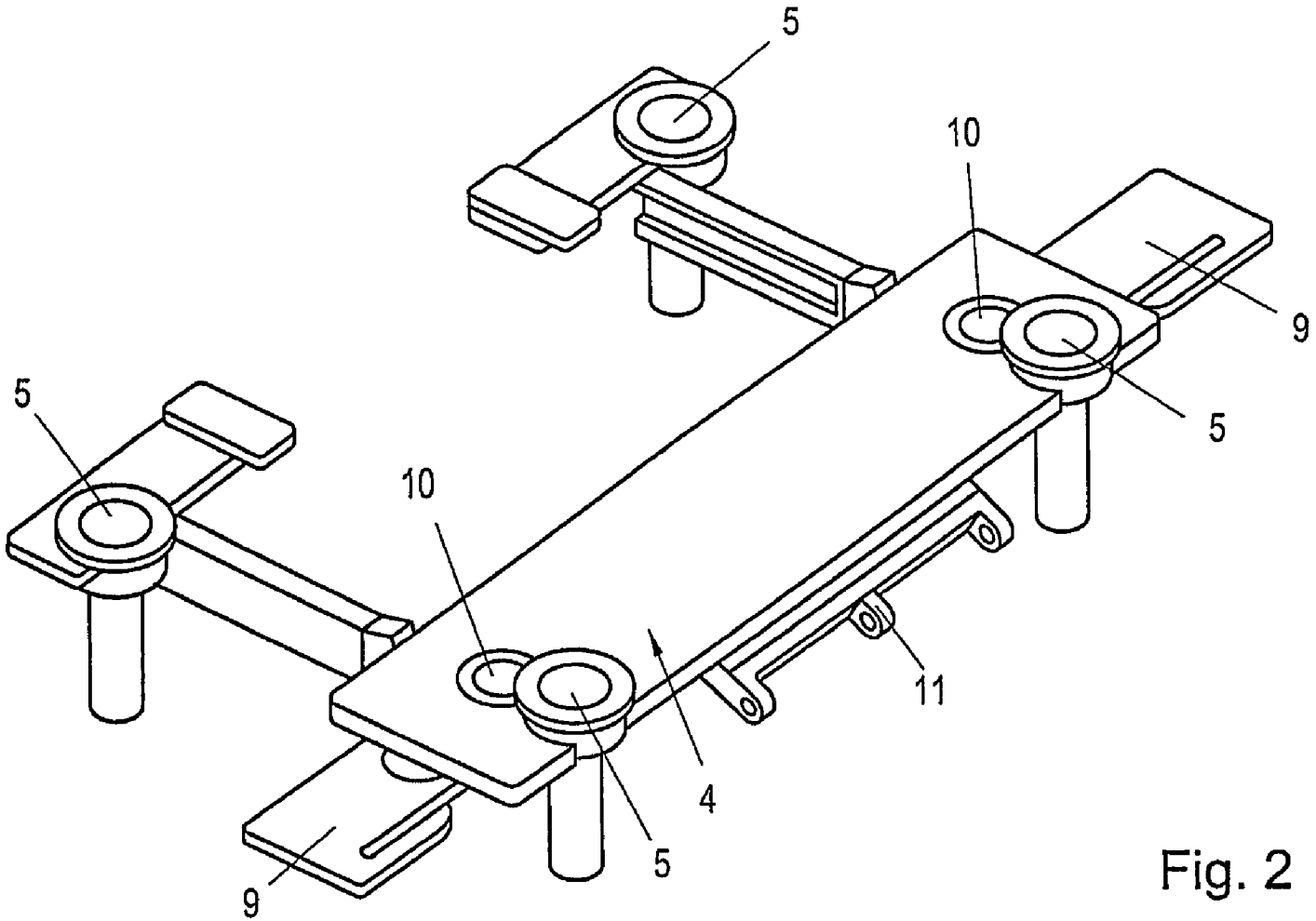
FIG. 2 is a detailed view of the roof bar.

FIG. 2 is a detailed illustration of the U-shaped roof bar 4 according to the invention, wherein the support cylinders are again denoted by 5, the deployable roof elements are denoted by 9, and the supporting points movably engaged by the support props (not illustrated) are denoted by 10. The bearing eye for the engagement of push rods is denoted by 11.

Figure 3:
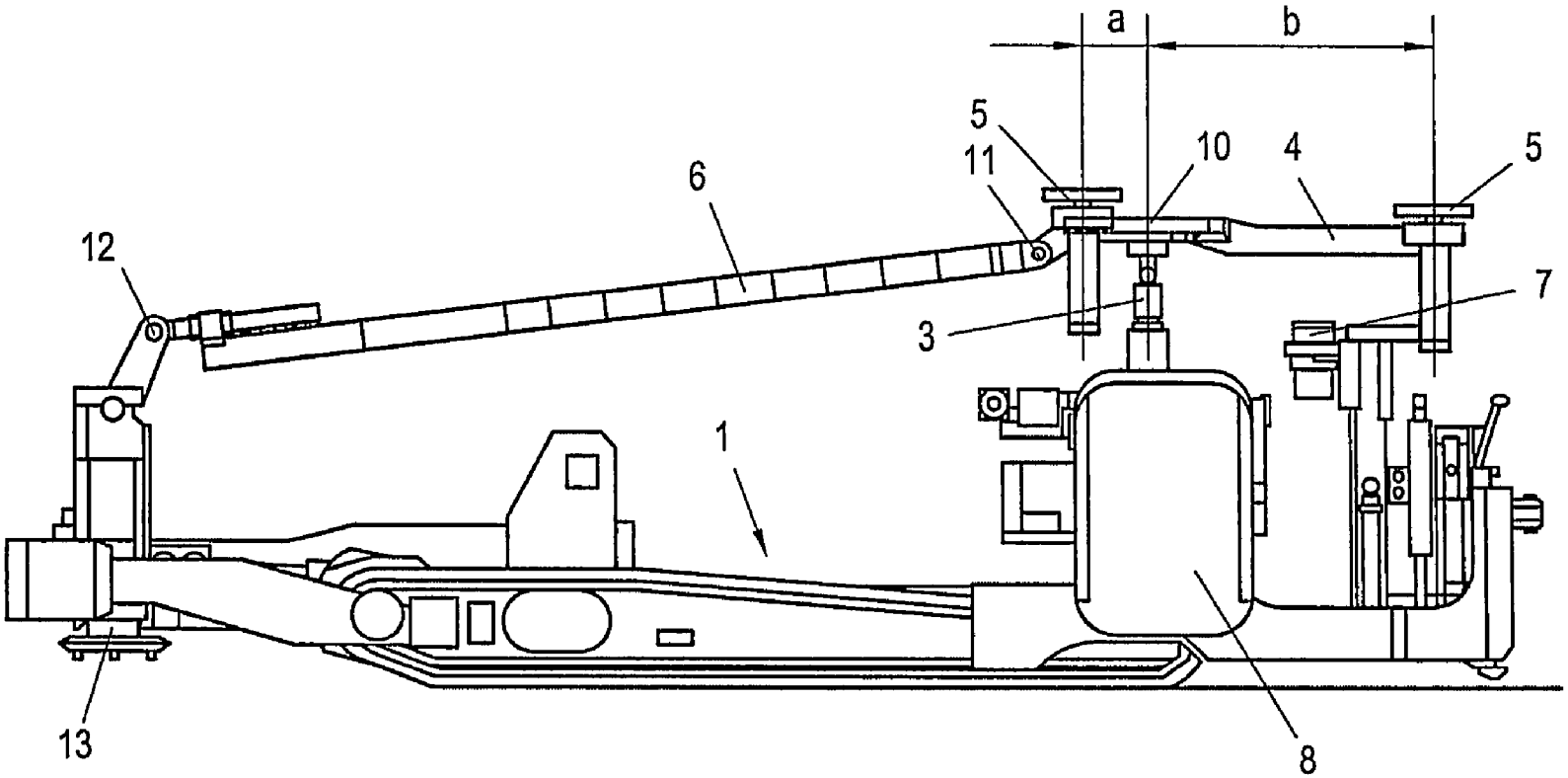
FIG. 3 is a schematic side view illustrating the mounting of the roof bar and the positioning of the support props.

FIG. 3 illustrates the U-shaped roof bar 4 according to the invention in side view. The reference numerals used in FIGS. 1 and 2 again denote identical components. The pivot axis formed by the support props 3, of the roof bar 4 is located at a distance from the support cylinders 5, which distance defines the two lever arms a and b. The support cylinders 5 arranged on the shorter arm a are thus able to exert more pressure than the support cylinders 5 arranged on the long lever arm b. The push rod 6 is again connected with the supporting device via the bearing eye 11, and with the frame of the advance working machine 1 via a hinge 12. Furthermore, a hydraulic prop 13 is provided to carry off roof forces into the soil via the push rods 6.

Figure 4:
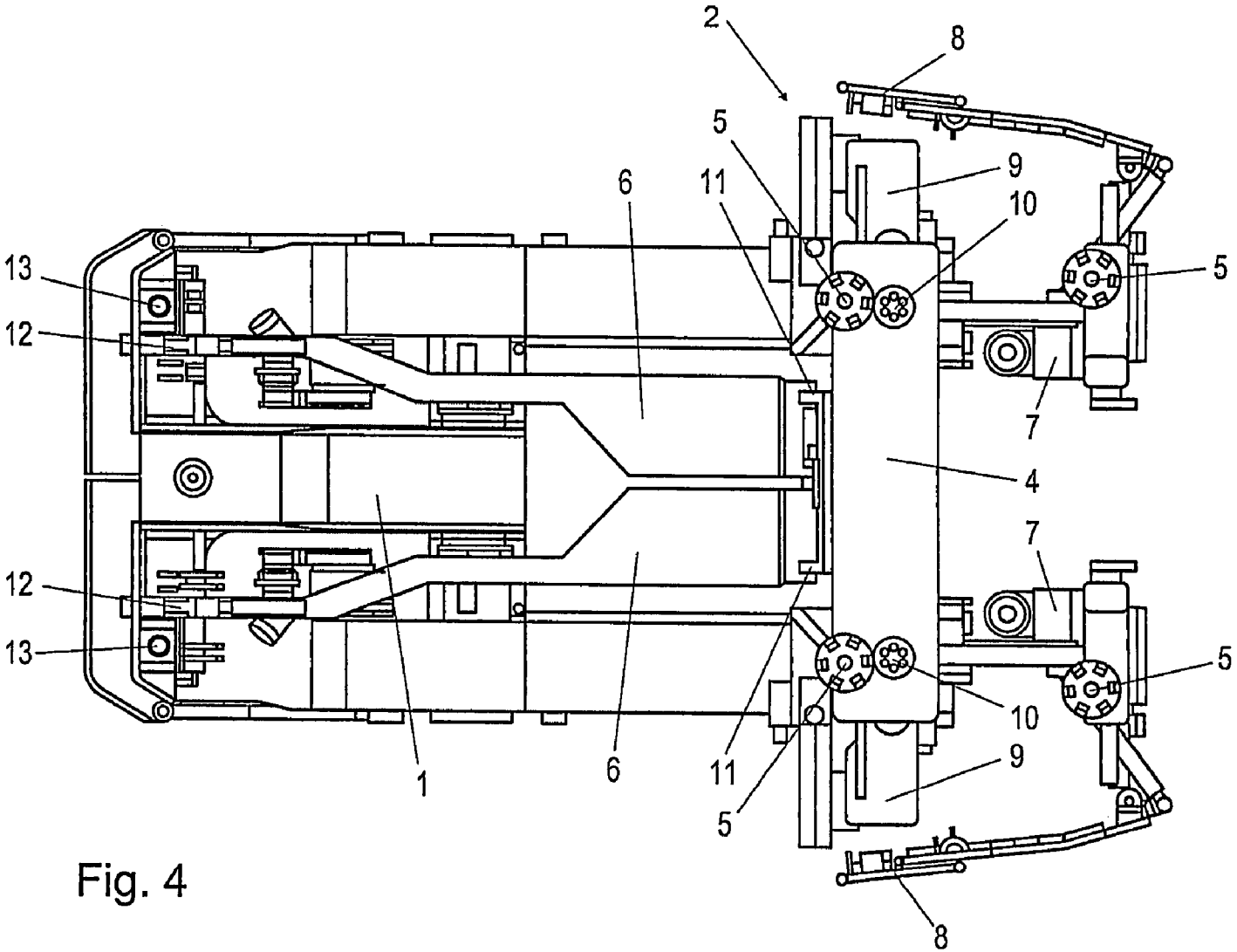
FIG. 4 is a top view on the advance working or mining machine according to the invention.

FIG. 4 is a top view on the advance working machine 1, wherein the anchor boring and setting device 7 can be used within the surface area stretched by the support cylinders 5, without colliding with the supporting device 2. Further protective features include the laterally adjustable protective shields 8 and the roof elements 9 extractable from the roof bar. The push rods, which are braced between the roof bar and the back of the machine via hinges 11 and 12, are denoted by 6. Also indicated are the supporting points 10 of the roof bar 4 and the rear hydraulic props 13, which impart additional stability to the advance working machine 1 also during cutting.

The invention claimed is:

1. A supporting device for an advance working or mining machine, comprising support props and at least one roof bar, wherein the roof bar comprises a plurality of hydraulic support cylinders with support stops, said support cylinders being positioned on sides of the roof bar facing away from the support props, and wherein the support cylinders are adapted to be braced against a roof separately from one another.

2. A supporting device according to claim 1, wherein the roof bar cooperates with at least two eccentrically engaging support props in a direction transverse to a longitudinal direction of the advance working or mining machine.

3. A supporting device according to claim 2, wherein the roof bar is formed in a U-shape in ground plan view, and has a pivot axis defined by points of engagement of the support props on the roof bar as seen in top view, and at least one of the support cylinders is arranged in a region of a free end of the U-shape, located on a forward side of the pivot axis, and at least one of the support cylinders is arranged in a region of the roof bar located on a rear side of the pivot axis opposite to the forward side of the pivot axis.

4. A supporting device according to claim 3, wherein a distance (b) between the pivot axis and said at least one support cylinder arranged on the forward side of the pivot axis is 2 to 7 times a distance (a) between the pivot axis and said at least one support cylinder arranged on the rear side of the pivot axis.

5. A supporting device according to claim 3, wherein a distance (b) between the pivot axis and said at least one support cylinder arranged on the forward side of the pivot axis is 3 to 5 times a distance (a) between the pivot axis and said at least one support cylinder arranged on the rear side of the pivot axis.

6. A supporting device according to claim 2, wherein a maximum hydraulic pressure of the support cylinders is set to be below 35% of a hydraulic pressure of the support props.

7. A supporting device according to claim 2, wherein a maximum hydraulic pressure of the support cylinders is set to be below 20% of a hydraulic pressure of the support props.

8. A supporting device according to claim 2, wherein the roof bar is articulately connected with a rear frame of the advance working or mining machine by push rods.

9. A supporting device according to claim 1, wherein the roof bar is formed in a U-shape in ground plan view, and that has a pivot axis defined by points of engagement of the support props on the roof bar as seen in top view, and at least one of the support cylinders is arranged in a region of a free end of the U-shape, located on a forward side of the pivot axis, and at least one of the support cylinders is arranged in a region of the roof bar located on a rear side of the pivot axis opposite to the forward side of the pivot axis.

10. A supporting device according to claim 9, wherein a distance (b) between the pivot axis and said at least one support cylinder arranged on the forward side of the pivot axis is 2 to 7 times, a distance (a) between the pivot axis and said at least one support cylinder arranged on the rear side of the pivot axis.

11. A supporting device according to claim 10, wherein the roof bar is articulately connected with a rear frame of the advance working or mining machine by push rods.

12. A supporting device according to claim 9, wherein a distance (b) between the pivot axis and said at least one support cylinder arranged on the forward side of the pivot axis is 3 to 5 times a distance (a) between the pivot axis and said at least one support cylinder arranged on the rear side of the pivot axis.

13. A supporting device according to claim 9, wherein the roof bar is articulately connected with a rear frame of the advance working or mining machine by push rods.

14. A supporting device according to claim 9, wherein the support cylinders are connected with a hydraulic controller maintaining a defined application pressure.

15. A supporting device according to claim 1, wherein a maximum hydraulic pressure of the support cylinders is set to be below 35%, of a hydraulic pressure of the support props.

16. A supporting device according to claim 1, wherein the roof bar is articulately connected with a rear frame of the advance working or mining machine by push rods.

17. A supporting device according to claim 1, wherein the support cylinders are connected with a hydraulic controller maintaining a defined application pressure.

18. A supporting device according to claim 1, wherein the support props are supported on a frame of the advance working or mining machine, and anchor boring and setting devices are supported on a frame of a loading device.

19. A supporting device according to claim 1, further comprising anchor boring and setting devices arranged within an area extending between the positions of the support cylinders, seen in top view.

20. A supporting device according to claim 1, wherein a maximum hydraulic pressure of the support cylinders is set to be below 20% of a hydraulic pressure of the support props.

* * * * *